United States Patent [19]

Inayama

[11] Patent Number: 4,863,056

[45] Date of Patent: Sep. 5, 1989

[54] FOLDING CONTAINER

[75] Inventor: Yusaku Inayama, Komaki, Japan

[73] Assignee: Kunimori Kagaku Co., Ltd., Aichi, Japan

[21] Appl. No.: 296,851

[22] Filed: Jan. 12, 1989

Related U.S. Application Data

[63] Continuation of Ser. No. 120,831, Nov. 16, 1987, abandoned.

[30] Foreign Application Priority Data

| | | | |
|---|---|---|---|
| Jul. 23, 1987 | [JP] | Japan | 62-113454 |
| Jul. 23, 1987 | [JP] | Japan | 62-113455 |
| Jul. 23, 1987 | [JP] | Japan | 63-113456 |
| Jul. 23, 1987 | [JP] | Japan | 62-113457 |
| Jul. 23; 1987 | [JP] | Japan | 62-113458 |

[51] Int. Cl.[4] ..... B65D 6/18

[52] U.S. Cl. ..... 220/6; 220/4 F; 217/15

[58] Field of Search ..... 220/6, 4 F; 217/15, 217/47

[56] References Cited

U.S. PATENT DOCUMENTS

| | | | |
|---|---|---|---|
| 1,064,328 | 6/1913 | Howell . | |
| 2,755,955 | 7/1956 | Gordon . | |
| 3,405,835 | 10/1968 | Eby . | |
| 3,796,342 | 3/1974 | Sanders et al. | 220/6 |
| 3,870,185 | 3/1975 | Sanders . | |
| 3,966,285 | 6/1976 | Porch . | |
| 4,099,640 | 7/1978 | Nessfield et al. . | |
| 4,148,407 | 4/1979 | Sinclair . | |
| 4,238,044 | 12/1980 | Roddier | 220/4 F |
| 4,300,695 | 11/1981 | Hsu . | |
| 4,320,845 | 3/1982 | Waller . | |
| 4,508,237 | 4/1985 | Kreeger et al. . | |
| 4,526,285 | 7/1985 | Cerveny et al. . | |
| 4,591,065 | 5/1986 | Foy . | |
| 4,624,381 | 11/1986 | Friedrich . | |
| 4,630,745 | 12/1986 | Shiotani | 220/6 |
| 4,630,746 | 12/1986 | Fortenberry | 220/6 |
| 4,630,747 | 12/1986 | Chiang et al. | 220/6 X |
| 4,674,647 | 6/1987 | Gyenge et al. . | |
| 4,693,387 | 9/1987 | Stonier | 220/6 |
| 4,720,020 | 1/1988 | Su | 220/6 |
| 4,798,304 | 1/1989 | Rader | 220/6 |

*Primary Examiner*—Steven M. Pollard

*Attorney, Agent, or Firm*—Frishauf, Holtz, Goodman & Woodward

[57] ABSTRACT

A folding container comprising: an upper frame having two pairs of opposing frame portions each having an engagement portion; a bottom frame with a closed end and having opposing frame portions which respectively correspond to those of the upper frame, each frame portion of the bottom frame having a pivotally support portion; two side plates pivotally supported at their lower end portions by the pivotally support portions, respectively, which are formed on one of the two pairs of frame portions of the bottom frame so that the side plates are able to pivot upward, each side plate being slidably supported at both lateral end portions thereof by the upper frame, the upper end portions of the side plates being engaged with the respective engagement portions formed on one of the two pairs of frame portions of the upper frame; and two end plates pivotally supported at their lower end portions by the pivotally support portions, respectively, which are formed on the other pair of frame portions of the bottom frame, the upper end portions of the end plates being engaged with the respective engagement portions formed on the other pair of frame portions of the upper frame. Accordingly, it is possible to readily assemble and fold the container and also possible to reduce the thickness of the container when folded.

5 Claims, 7 Drawing Sheets

12b
12
10
12a
12c
12d
12f
5a
14
17c
37
9
17
7b
21
19
23
39
25
37a
5
17b
27
29a
29
9a
7
35
3b
33
43
15
3d
3a
3
41
11
3c

FOLDING CONTAINER

This application is a continuation of application Ser. No. 120,831, filed Nov. 16, 1987, now abandoned.

BACKGROUND OF THE INVENTION

1. Field of the Invention

The present invention relates to a folding container used to transport or convey articles.

2. Description of the Related Art

A typical conventional folding container has heretofore been arranged such that two pairs of opposing side plates are pivotally supported at their lower and portions by a bottom plate in such a manner that the side plates are able to be raised to their erected position and the end portions of the erected side plates are joined together by means of connecting members to thereby form the constituent elements into a box-like configuration.

The above-described type of conventional container suffers, however, from the following problems. When a multiplicity of containers accommodating articles are stacked up, since each container has no upper frame for supporting the side plates, the load of the upper container is applied directly to the side plates of the lower container. As a result, the side plates of the lower container which are adjacent to each other may be disengaged, so that it is impossible to safely accommodate articles and it is also impossible to efficiently stack up a multiplicity of containers. Further, it is necessary in order to bear the load of the upper container to increase the thickness of the side plates, and in order to obtain high connecting strength, the structure of the connecting member must be complicated, which results in a rise in the production cost of the container itself. In addition, since the thickness of the conventional container when folded is relatively large, the prior art suffers from inferior stacking efficiency.

SUMMARY OF THE INVENTION

In view of the above-described circumstances, it is an object of the present invention to provide a folding container which can be readily assembled and folded and which can be mass-produced at reduced cost.

It is another object of the present invention to provide a folding container which is so designed that it is possible to reduce the thickness of the container when folded and it is therefore possible to improve the stacking efficiency.

It is still another object of the present invention to provide a folding container which has sufficiently high strength to bear the load applied thereto from the upper containers when a multiplicity of containers accommodating articles are stacked up.

It is a further object of the present invention to provide a folding container which is so designed that it is possible to reliably prevent damage to containers when a multiplicity of containers are stacked up, which damage would otherwise have been caused as a result of disengagement of the upper frame from the side and end plates.

The above and other objects, features and advantages of the present invention will become clear from the following description of the preferred embodiment thereof taken in conjunction with the accompanying drawings.

DESCRIPTION OF THE PREFERRED EMBODIMENT

One embodiment of the present invention will be described hereinunder in detail with reference to the accompanying drawings.

Figure 1:
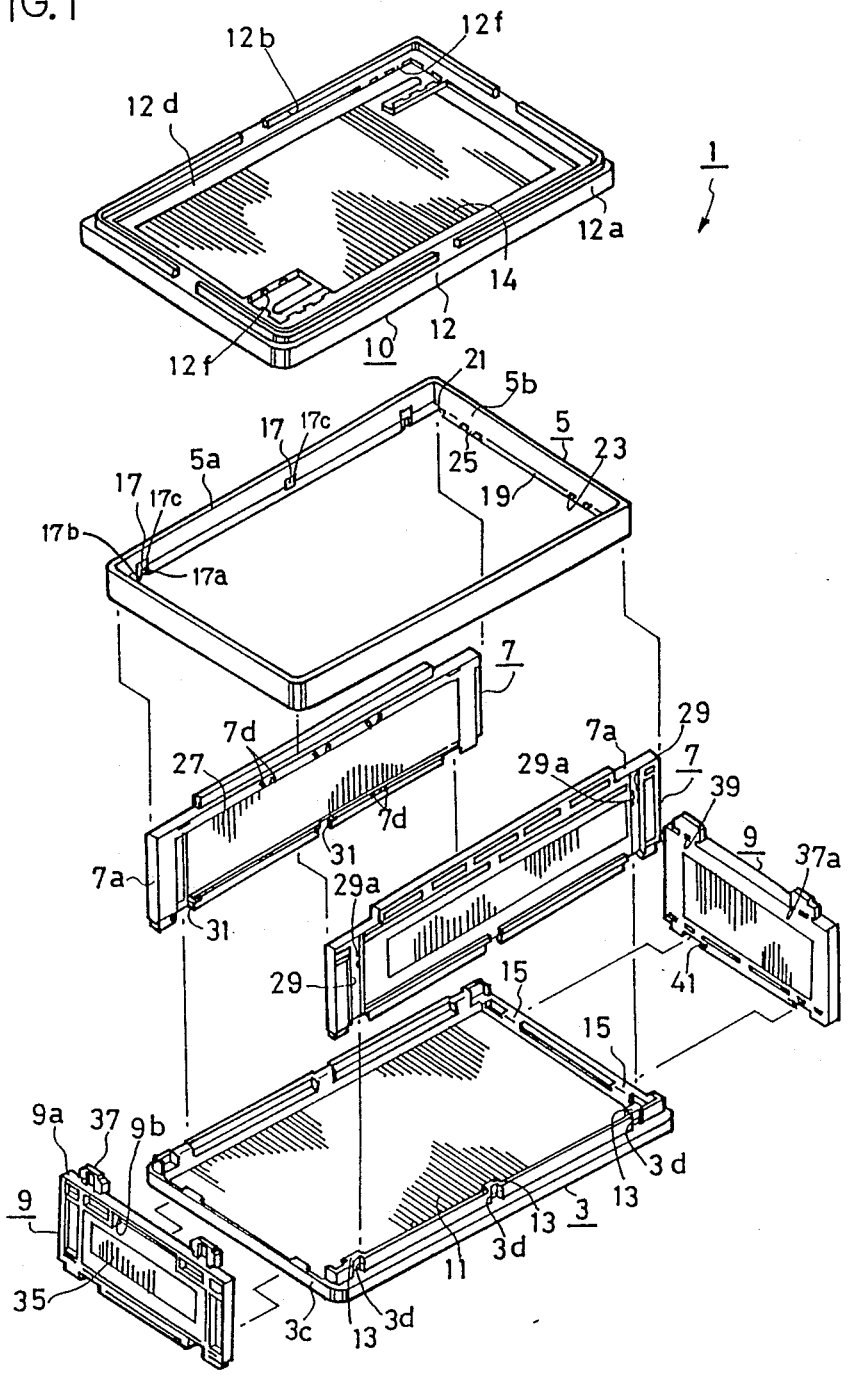
FIG. 1 is an exploded perspective view of one embodiment of the folding container according to the present invention.
Figure 2:
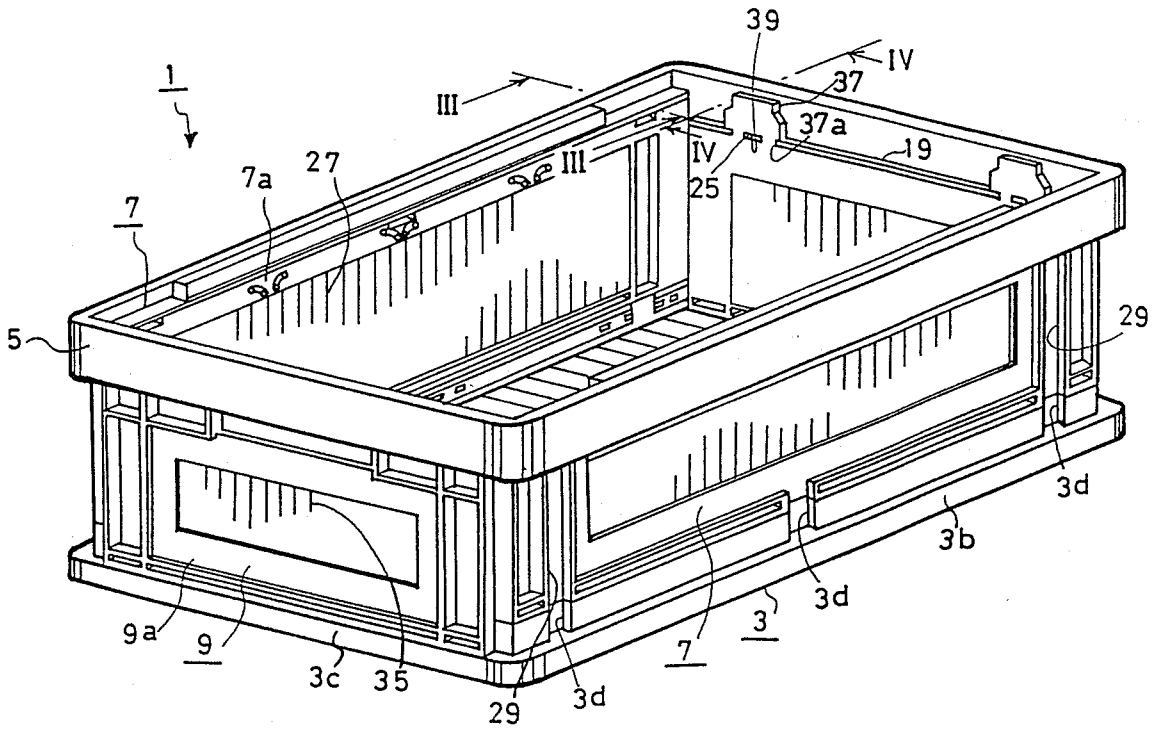
FIG. 2 is a perspective view of the assembled folding container.
Figure 3:
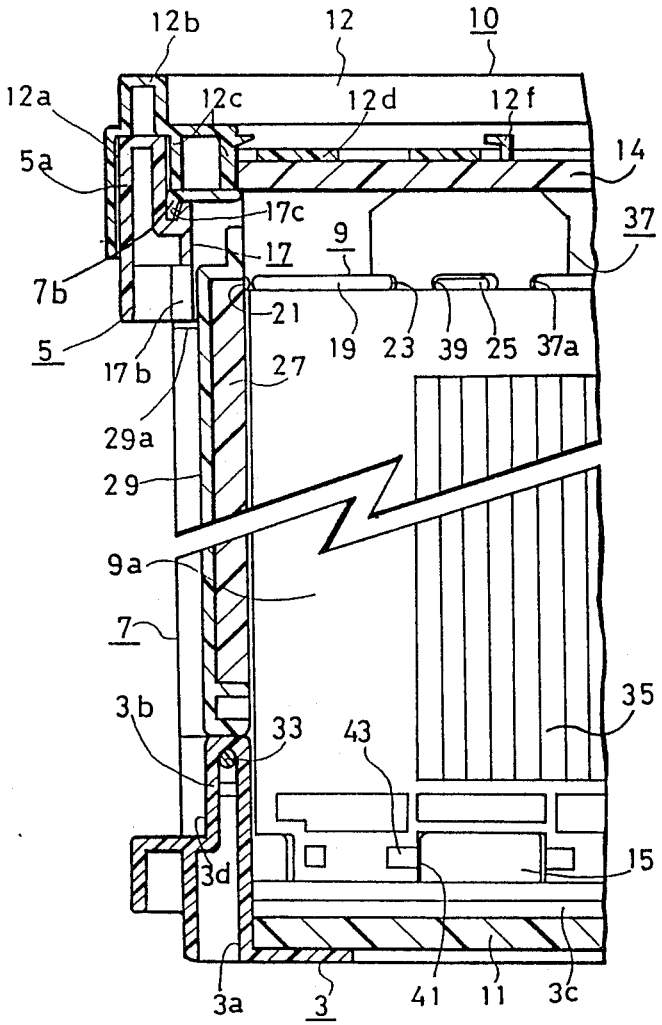
FIG. 3 is a fragmentary sectional view taken along the line III—III of FIG. 2, which shows the folding container with its cover attached thereto.
Figure 4:
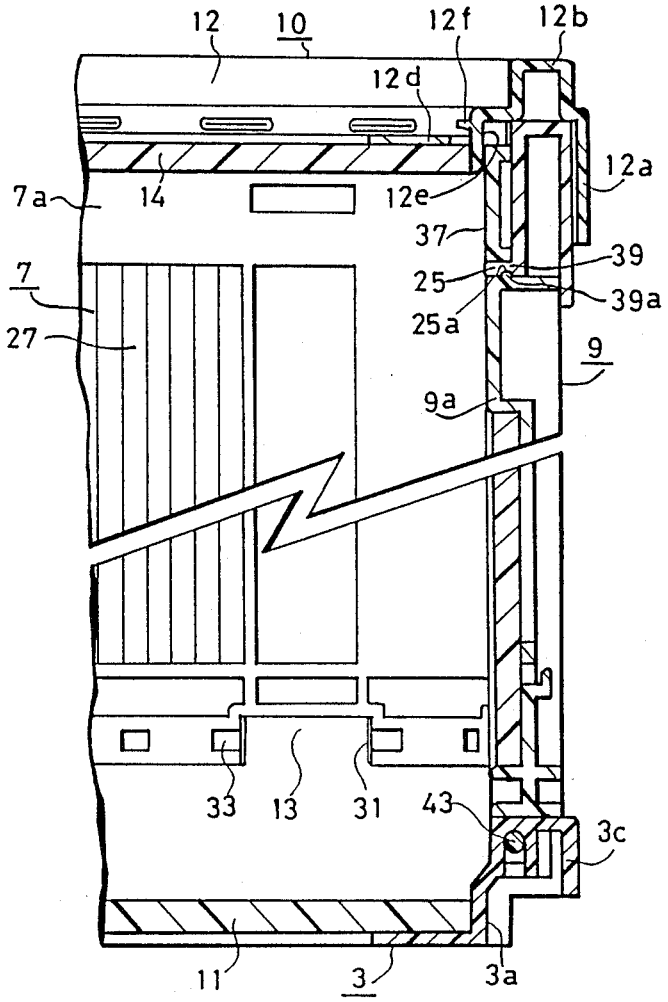
FIG. 4 is a fragmentary sectional view taken along the line IV—IV of FIG. 2, which shows the folding container with its cover attached thereto.

FIG. 1 is an exploded perspective view of one embodiment of the folding container according to the present invention, FIG. 2 is a perspective view of the assembled folding container, FIG. 3 is a fragmentary sectional view taken along the line III—III of FIG. 2, which shows the folding container with its cover attached thereto, and FIG. 4 is a fragmentary sectional view taken along the line IV—IV of FIG. 2, which shows the folding container with its cover ataached thereto. As shown in the figures, the folding container 1 comprises a bottom frame 3, an upper frame 5, a pair of opposing side plates 7, a pair of opposing end plates 9, and a cover 10.

The bottom frame 3 is formed from a synthetic resin into a rectangular frame-shaped configuration which has an opening in its center and an engagement step portion 3*a* formed on its bottom. A pair of opposing longer frame portions 3*b* and a pair of shorter frame portions 3*c* are formed integral with the four sides, respectively, of the bottom frame 3. A resin corrugated plate 11 is rigidly secured to the upper surface of the engagement step portion 3*a* by means, for example, of resin rivets or ultrasonic welding. An engagement recess 3*d* is formed in the outer surface of each longer frame portion 3*b*. First pivotally support portions 13 are formed integral with the inner surface of each longer frame portion 3*b*, the support portions 13 being respectively disposed at the center and two end portions of the frame portion 3*b* so as to project inward. Each of the first pivotally support portions 13 has a necessary width and is provided with a pivotally support bore (not shown) which is formed in its center. Each shorter frame portion 3*c* has second pivotally support portions 15 formed integral with its inner surface at two end portions, respectively. Each support portion 15 has a necessary width and projects inward at a position below the first pivotally support portions 13. Each support portion 15 also has a pivotally support bore (not shown) in its center.

The upper frame 5 is formed from a synthetic regin into a rectangular frame-shaped configuration which corresponds to the bottom frame 3. More specifically, the upper frame 5 has a pair of opposing longer frame portions 5*a* and a pair of opposing shorter frame portions 5*b*, which are formed integral therewith. Projections 17 are formed integral with the inner surface of each longer frame portion 5*a* at its center and two end portions, respectively. The projections 17 are adapted to support the lower surface of the engagement step portion 3*a* of the bottom frame 3. Each of the projections 17 which are disposed at the end portions has an engagement recess 17*c* formed in its upper end and a resilient arm 17*b* formed integral with its lower end, the arm 17*b* extending downward and having an engagement portion 17*a* extending outward. Each shorter frame portion 5*b* has a rib 19 formed integral with its inner surface, the rib 19 having a necessary width and projecting inward. The rib 19 has a first notched portion 21 formed at each end thereof for slidably supporting the corresponding side plate 7 (described later), the notched portion 21 having a width corresponding to the thickness of the side plate 7. A second notched portion 23 is formed in that portion of the rib 19 which is located inwardly of each end thereof, the notched portion 23 being engageable with the corresponding projecting piece 37. An engagement piece 25 having a recess 25*a* in its lower surface is formed integral with that portion of each shorter frame portion 5*b* which is coincident with the second notched portion 23.

Each side plate 7 is pivotally supported at its lower end by the first pivotally supporting portions 13 of the bottom frame 3 in such a manner that the side plate 7 is able to pivot upward from the inner side of the folding container. The side plate 7 comprises a frame plate 7*a* made of a synthetic resin and having an opening in its center, and a resin corrugated plate 27 which is rigidly secured to the frame plate 7*a* by means, for example, of resin rivets or ultrasonic welding so that the corrugated plate 27 covers the opening of the frame plate 7*a*. The frame plate 7*a* has grooves 29 formed in its outer surfaces at positions which are coincident with the projections 17, respectively, the grooves 29 having a necessary width and extending vertically so that the projections 17 are engageable therewith. Among the grooves 29, the groove 29 which is located at each end of the frame plate 7*a* has an engagement portion 29*a* which is engaged with the corresponding engagement portion 17*a* of the upper frame 5 when moved upward. An engagement projection 7*b* is formed integral with that portion of the frame plate 7*a* which is coincident with the upper end of the groove 29 at each end of the frame plate 7*a* so that the engagement projection 7*b* is engageable with the corresponding engagement recess 17 of the upper frame 5. Notches 31 for pivotal support are formed at the lower end portion of the frame plate 7*a* in correspondence with the first pivotally support portions 13, respectively, of the bottom frame 3. A pivotally support bore (not shown) is formed in that portion of the lower end of the frame plate 7*a* which is located at each side of each notch 31. A pivot pin 33 which is made of an elastically deformable synthetic resin is inserted into the pivotally support bores corresponding to each notch 31 and also into the pivotally support bore in the corresponding first pivotally support portion 13. Thus, each side plate 7 is supported by the first pivotally support portions 13 so that it is able to pivot upward from the inner side of the folding container. It should be noted that the lower end surface of that portion of the frame plate 7*a* which faces the corresponding first pivotally support portion 13 is formed into a flat surface so that it is substantially coincident with the upper surface of said first pivotally support portion 13. In addition, a plurality of pairs of opposing support projections 7*d* are formed integral with each of the upper and lower portions of the inner surface of the frame plate 7*a*, each pair of support projections 7*d* having a gap therebetween so that a partition plate (not shown) can be received therebetween.

Each end plate 9 is pivotally supported at its lower end by the second pivotally support portions 15 of the bottom frame 3 in such a manner that the end plate 9 is able to pivot upward from the inner side of the folding container. The end plate 9 comprises a frame plate 9*a* made of a synthetic resin and having an opening in its center, and a resin corrugated plate 35 which is rigidly secured to the frame plate 9*a* by means, for example, of resin rivets or ultrasonic welding so that the corrugated plate 35 covers the opening of the frame plate 9*a*. A recess 9*b* for grip is formed in the outer surface of the upper portion of the frame plate 9*a*. Further, engagement pieces 37 which are engageable with the second notched portions 23 are formed integral with two end portions of the upper side of the frame plate 9*a*, and notches 37*a* which are engageable with the above-described rib 19 are formed at both sides, respectively, of the lower end of each engagement piece 37. Each engagement piece 37 is provided with an engagement bore 39 having a projection 39*a* which is engageable with the corresponding recess 25*a* described above, the engagement bore 39 being formed at a position which is substantially coincident with the upper end of the frame plate 9*a*. Notches 41 for pivotal support are formed in the lower end portion of the frame plate 9*a* in correspondence with the second pivotally support portions 15, respectively. A pivotally support bore (not shown) is formed in that portion of the frame plate 9*a* which is located at each side of each notch 41. A pivot pin 43 which is made of an elastically deformable synthetic resin is inserted into the pivotally support bores corresponding to each notch 41 and the pivotally support bore in the corresponding second pivotally support portion 15. Thus, each end plate 9 is pivotally supported by the second pivotally support portions 15.

The cover 10 comprises a frame plate 12 and a resin corrugated plate 14. The frame plate 12 is made of a synthetic resin and has such a size that the cover 10 can be fitted on the outer side surfaces of the upper portion of the upper frame 5. The corrugated plate 14 is rigidly secured to the frame plate 12 by means, for example, of resin rivets or ultrasonic welding. The frame plate 12 consists of a downward extending portion 12*a* which extends downward along the outer side surfaces of the upper frame 5, a rising portion 12*b* which is engaged with the engagement step portion 3*a* of the bottom frame 3 of another folding container which is stacked thereon, an inner wall portion 12*c* which is engaged with the inner surface of the upper portion of the upper frame 5, and a flat surface portion 12*d* which extends inward. The inner wall portion 12*c* is provided with recesses 12*e* which receive the respective engagement pieces 37 when the cover 10 is attached to the upper frame 5. Further, projections 12*f* are formed integral with the flat surface portion 12*d* at each of the diagonal positions in such a manner that a shipping tag (not shown) is able to be inserted into the space defined between the flat surface portion 12*d* and the projections 12*f* and the end portions of the shipping tag is retained by the projections 12*f*.

The way in which the folding container arranged as detailed above is assembled will next be described with reference to FIGS. 3 to 8.

Figure 5:
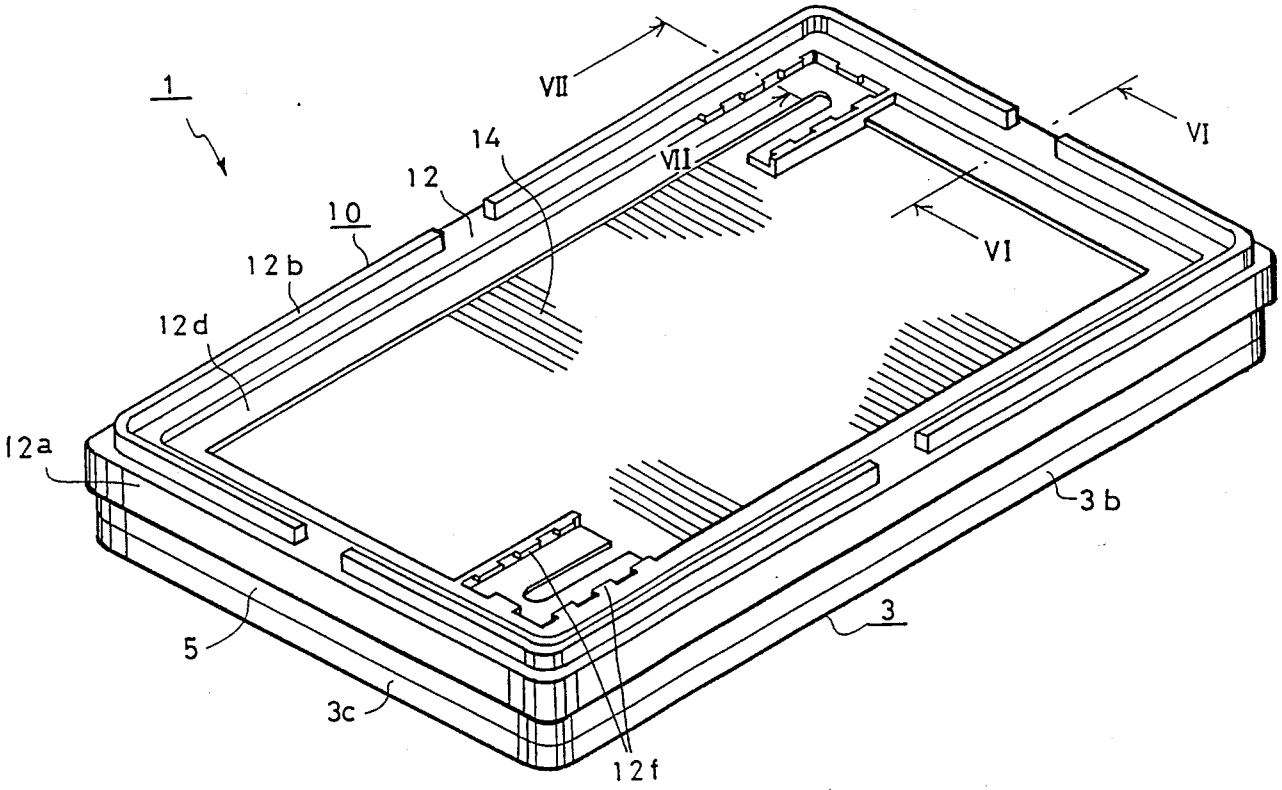
FIG. 5 is a perspective view of the folding container in a folded state.
Figure 6:
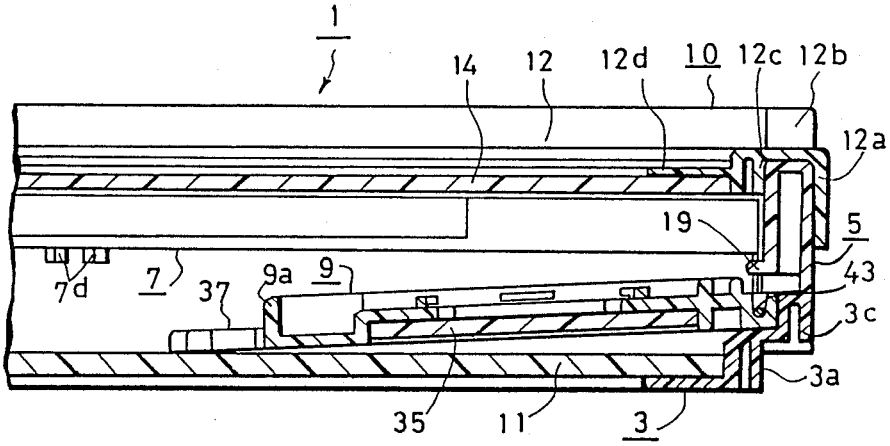
FIG. 6 is a fragmentary sectional view taken along the line VI—VI of FIG. 5.
Figure 7:
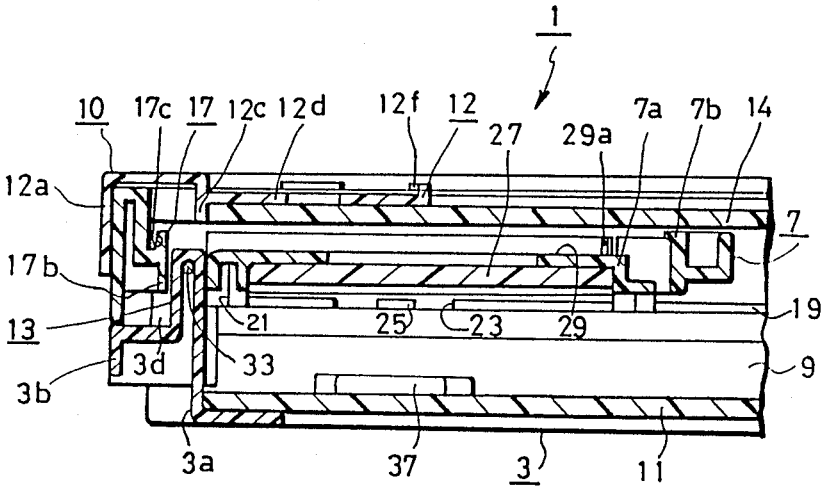
FIG. 7 is a fragmentary sectional view taken along the line VII—VII of FIG. 5.

FIG. 5 shows the folding container in a folded state, FIG. 6 is a fragmentary sectional view taken along the line VI—VI of FIG. 5, and FIG. 7 is a fragmentary sectional view taken along the line VII—VII of FIG. 5. Referring to these figures, the second pivotally support portions 15 of the bottom frame 3 are fitted into the respective notches 41 of each end plate 9, and the pivot pin 43 is inserted into the pivotally support bore in each second pivotally support portion 15 and also into the pivotally support bores in the corresponding lower end portions of the frame plate 9*a*, thereby enabling a pair of opposing end plates 9 to be pivotally supported by the shorter frame portions 3*c* of the bottom frame 3 so that the end plates 9 are able to pivot upward from the inner side of the folding container. Each end plate 9 is folded inward so that it is supported on the upper surface of the bottom frame 3.

Next, both end portions of the frame plate 7*a* of each side plate 7 are fitted into the respective first notched portions 21 of the upper frame 5 and, in this state, the first pivotally support portions 13 are fitted into the respective notches 31 of the side plate 7. Then, the pivot pin 33 is inserted into the pivotally support bore in each first pivotally support portion 13 and also into the corresponding pivotally support bores in the side plate 7, thereby enabling a pair of opposing side plates 7 to be pivotally supported by the respective longer frame portions 3*b* of the bottom frame 3 so that the side plates 7 are able to pivot upward from the inner side of the folding container. The upper frame 5 having both end portions of the frame plate 7*a* slidably supported by the first notched portions 21 is joined to the bottom frame 3 in one unit in such a manner that the engagement projections 7*b* and the engagement recesses 3*d* are engaged with each other. The side plates 7 which are folded inward about the pivot pins 3 are supported on the upper surfaces of the ribs 19 of the upper frame 5.

The folding container 1 which has been assembled and folded as described above is then erected as follows.

Figure 8:
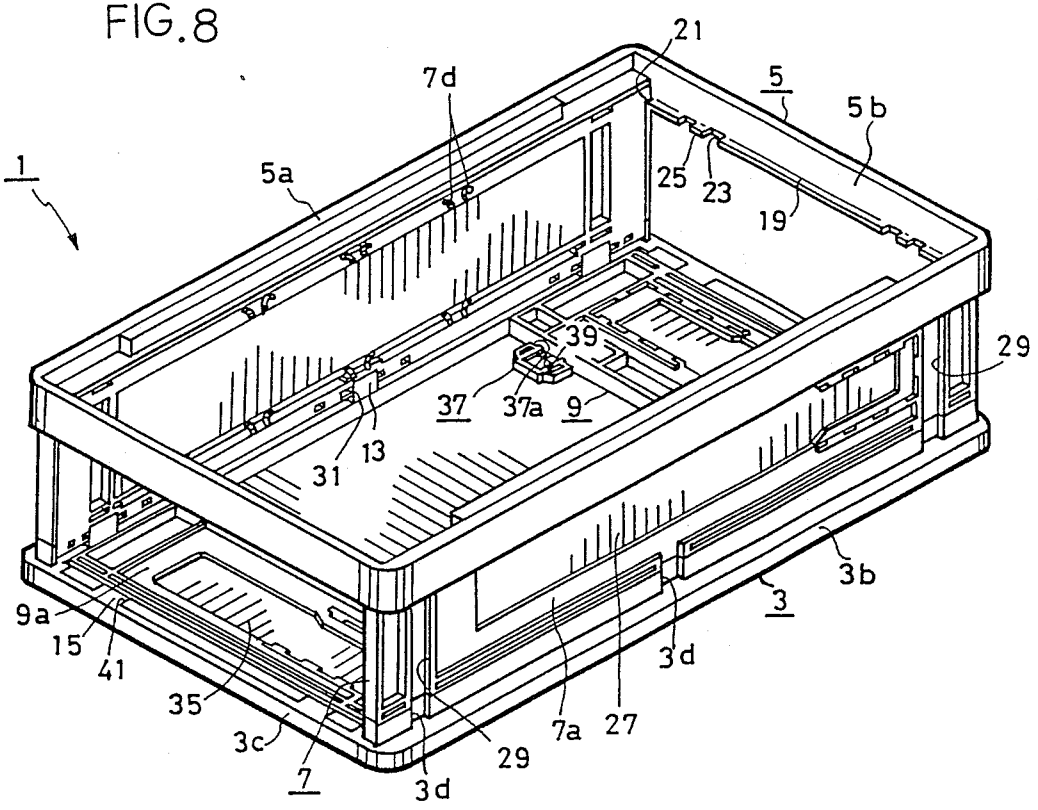
FIG. 8 is a perspective view of the folding container when being assembled.

Referring to FIGS. 3, 4 and FIG. 8 which show the folding container in the course of erecting process, the side plates 7 which are in the position shown in FIG. 5 are raised from the inner side of the container in such a manner that they are pivoted upward about the pivot pins 33. Since the lower end surface of the frame plate 7*a* and the upper end surfaces of the first pivotally support portions 13 are formed so as to be substantially flat, when the inner edge of the lower end of the frame plate 7*a* moves in slide contact with the upper end surfaces of the first pivotally support portions 13, the pivot pins 33 are elastically deformed. Thus, each side plate 7 is allowed to pivot upward, and when the side plate 7 has been erected, the lower end surface of each frame plate 7*a* is brought into contact with the upper end surfaces of the first pivotally support portions 13 by virtue of the elastic restoration of the pivot pins 33, and the side plates 7 are thus maintained in their erected position. In addition, when the side plates 7 are erected, the projections 17 are engaged with the respective grooves 29.

With the side plates 7 held in their erected state, the upper frame 5 is moved upward. Consequently, both end portions of each frame plate 7*a* are supported by the respective first notched portions 21 of the upper frame 5, thus preventing the side plates 7 and the upper frame 5 from disengaging from each other. The projections 17 are slid upward while being in engagement with the respective grooves 29.

When the upper frame 5 has been moved to its raised position, the engagement portions of the projections 17 are engaged with the respective engagement portions 29*a* and the engagement projections 7*b* are engaged with the respective engagement recesses 17*c*. Thus, the upper frame 5 is maintained in its raised position in a state wherein it is joined to the side plates 7 in one unit.

When, in the above-described state, the end plates 9 are pivoted upward about the pivot pins 43, the engagement pieces 37 are engaged with the respective second notched portions 23. At this time, the ribs 19 are retained by the respective notches 37*a* in the engagement pieces 37, and the engagement pieces 25 are fitted into the respective engagement bores 39 so that the projections 39*a* are engaged with the respective recesses 25*a*, thereby enabling the end plates 9 to be maintained in their erected position, and thus completing the or erecting of the folding container 1.

Then, articles are accommodated in the container 1 assembled as described above, and the cover 10 is attached to the upper side of the container 1 in such a manner that the downward extending portion 12*a* is fitted on the outer side surfaces of the upper frame 5 and the inner wall portion 12*c* is supported on the upper end surface of the upper frame 5. At this time, the engagement pieces 37 of the end plates 9 are engaged with the respective recesses 12*e* of the cover 10, thereby preventing the end plates 9 from falling inward.

When another container 1 is stacked on the container 1 having the cover 10 attached thereto, the engagement step portion 3*a* of the bottom frame 3 of the upper container 1 is engaged with the rising portion 12*b* of the cover 10 of the lower container 1, thereby enabling the cover 10 to be securely attached to the upper frame 5 and also permitting the end plates 9 to be maintained in their erected position.

It should be noted that the folding container 1 is folded by reversely carrying out the foregoing procedure. More specifically, after the end plates 9 have been folded inward; the upper frame 5 is moved downward so as to be joined to the bottom frame 3 in one unit, and the side plates 7 are then folded inward.

Although the present invention has been described above through specific terms, it should be noted here that the described embodiment is not necessarily exclusive and various changes and modifications may be imparted thereto without departing from the scope of the invention which is limited solely by the appended claims.

What is claimed is:

1. A folding container comprising:

a rectangular upper frame (5) including a first pair of opposing sides each having an inside portion which is provided with an engaging portion (17*a*); and a second pair of opposing sides each being provided with first notched portions (21) at both ends thereof and second notched portions (23) between said first notched portions (21);

a rectangular bottom frame (3) including a first pair of opposing sides corresponding to said first pair of opposing sides of said upper frame (5) and each being provided with first pivotal support portions (13) on an outer peripheral portion thereof; and a second pair of opposing sides corresponding to said second pair of opposing sides of said upper frame (5) and each being provided with second pivotal support portions (15) on an outer peripheral portion thereof at substantially the same plane as said first pivotal support portions (13);

said upper (5) being foldable downwardly toward said bottom frame (3), and being liftable relative to said bottom frame (3) during erection of the container;

a pair of side plates (7) each of which are pivotally connected to said first pivotal support portions (13) of a respective one of said first pair of opposing sides of said bottom frame so as to be movable relative to said bottom frame (3), said side plates (7) each having upper end portions which are equal in length to an upper end surface of said upper frame (5) when said side plates (7) are in an erected position, and said side plates (7) each having means at end portions thereof for slidably engaging and being retained by said first notched portions (21) of said second pair of a respective one of opposing sides of said upper frame (5) during lifting of said upper frame (5) relative to said bottom frame (3) so that said side plates (7) are supported by said first notched portions (21) when said side plates are in said erected position; said pair of side plates (7) each having respsective grooves (29) and engaging portions (29*a*) for slidably and supportingly engaging said engaging portions (17*a*) of a respective one of said first pair of opposing sides of said upper frame (5) by coming into engagement with said first pair of opposing sides of said upper frame (5), said side plates (7) being supported in an erected or upright position by said upper frame (5) when the container is in a partially erected state with only said side plates (7) erected; and a pair of end plates (9) positioned between said pair of side plates (7) and being pivotally connected to said second pivotal support portions (15) of said second pair of opposing sides of said bottom frame (3) so as to be movable relative to said bottom frame (3), said end plates (9) each having upper portions which are engaged with lower end portions of said upper frame (5) when said end plates (9) are in an erected or upright position, and said end plates (9) having upper edges which have engaging members (37) thereon which are engageable with said second notched portions (23) of said second pair of opposing sides of said upper frame (5) so as to be thereby supported in said erected or upright position by said upper frame (5) when the container is in a fully erected state with both said side plates (7) and said end plates (9) in an erected or upright position.

2. The folding container of claim 1, wherein said upper frame comprises a cover having downwardly extending portion which is engageable with inner surfaces of said engagement members (37), which are engaged with said second notched portions (23) when said cover is attached to said upper frame of an assembled container thereby preventing disengagement of said engagement members from said second notched portions and preventing falling of said end plates.

3. The folding container of claim 1, wherein said upper frame is slidable relative to said side plates when being raised relative to said bottom frame to an erected position.

4. The folding container of claim 1, wherein, in a folded state, said end plates are folded on said bottom frame, said upper frame is over said folded end plates, and said side plates are folded over at least a portion of said upper frame.

5. The folding container of claim 4, wherein said upper frame has inwardly projecting ribs on which said side plates are folded, said first and second notched portions being formed in said ribs.

* * * * *